United States Patent [19]

Könnemann et al.

[11] Patent Number: 4,540,234

[45] Date of Patent: Sep. 10, 1985

[54] ROUND PLUG SOCKET PROVIDED WITH AN OVER-SPRING

[75] Inventors: Alfred Könnemann; Jörgen Ehrenberg, both of Wuppertal, Fed. Rep. of Germany

[73] Assignee: Grote & Hartmann GmbH & Co. KG, Fed. Rep. of Germany

[21] Appl. No.: 548,983

[22] Filed: Nov. 4, 1983

[30] Foreign Application Priority Data

Nov. 10, 1982 [DE] Fed. Rep. of Germany ..... 3241485

[51] Int. Cl.[3] ..... H01R 13/18; H01R 11/22

[52] U.S. Cl. ..... 339/259 R; 339/256 R; 339/258 R; 339/262 R

[58] Field of Search ..... 339/256 R, 256 C, 256 RT, 339/258 R, 258 A, 258 P, 258 RR, 259 R, 262 R, 262 RR, 252 R, 253 R, 255 R

[56] References Cited

U.S. PATENT DOCUMENTS 2,979,689 4/1961 Jackson et al. ..... 339/258 R X
4,168,880 9/1979 Tesch ..... 339/259 R
4,341,434 7/1982 Pfister ..... 339/256 R

FOREIGN PATENT DOCUMENTS 7133507 12/1971 Fed. Rep. of Germany ..... 339/256

*Primary Examiner*—Gil Weidenfeld
*Assistant Examiner*—Steven C. Bishop
*Attorney, Agent, or Firm*—Goodman & Teitelbaum

[57] ABSTRACT

A round plug socket including a conductor securing portion and a cylindrical spring arm base portion provided with spring arms connected to the front edge of the spring arm base portion, the spring arms being spaced from one another and being bent inward. A plug ring is provided on the front side of the spring arms. The plug ring is embraced by a ring portion of an over-spring which is slit in a longitudinal direction of the round plug socket. Securing members for unreleasably seating the over-spring ring portion on the round plug socket are provided, which preferably also limit the opening of the over-spring to protect against any over-bending of the spring arms during contact thereof with a male plug inserted into the round plug socket.

23 Claims, 7 Drawing Figures

ROUND PLUG SOCKET PROVIDED WITH AN OVER-SPRING

This invention relates to a round plug socket formed from a sheet-metal stamped part, which is provided with an over-spring likewise being formed from a sheet-metal stamped part.

From German utility model No. 71 33 507, there is known a round plug socket which includes a conductor securing portion and a plug portion. The plug portion is connected to the conductor securing portion with a cylindrically rolled spring arm base which presents abutment edges extending in a longitudinal direction, and to which there are connected three spring arm contacts extending forward in extension of the cylinder wall. The spring arm contacts are arranged "on gap", i.e with a lateral spacing from one another. With their front end, the spring arm contacts are attached to a cylindrical plug ring likewise presenting abutment edges extending in a longitudinal direction. For the formation of the contact areas for contacting a fitting round plug, the spring arm contacts are bent arcuately toward the interior of the round plug socket. On the plug ring, there are connected, moreover, spring arm stops, and namely, being in the gaps between the spring arm contacts. The spring arm stops extend rearward, being of equal length or shorter than the spring arm contacts, and being bent outward.

This known round plug socket has proved itself very well. Accordingly, an object of the present invention is to increase the spring forces of the round plug socket when the spring arm contacts are arranged in a lateral spacing from one another and, in so doing, also to provide a protection against any bending open of the plug ring, especially, however, also a protection against any bending open of the spring arm base.

This object is obtained according to the present invention by an over-spring turned inside-out over the round plug socket in the plug portion.

It is a known practice in the prior art to provide an over-spring for a round plug socket. The known over-spring includes a cylindrical portion which embraces a cylindrical base portion of the round plug socket, in which arrangement the abutment edges of the over-spring overlap. On the rearward edge of the over-spring, in lateral spacing from one another, there are attached arm stops which are bent outward and extend rearwardly. On the front edge of the cylindrical portion of the over-spring, there is connected a forward-directed arm, which forms a type of spring arm, which is connected to a closed ring. The abutment edges of the ring are solidly joined with one another. The ring surrounds an annular plug portion of the round plug socket, which presents oppositely lying abutment edges, the ring being joined by a semi-hollow cylindrical connecting strap to the base portion. The spring arm of the over-spring covers the longitudinal opening of the connecting strap, in which arrangement an inward-bent portion of the spring arm serves as the spring contact-pressure element for the contact pin, whereby the contact pin is pressed against the bottom of the plug ring and/or of the connecting strap, so that the desired contact can be assured. However, this prior art spatial form is not usable for a round plug socket provided with spring arms arranged with a lateral spacing therebetween. Neither can this prior art form give a hint for the arrangement of an over-spring on a round plug socket of the type described above as an improvement with respect to the German prior art reference.

With the above and additional objects and advantages in view, as will hereinafter appear, this invention comprises the devices, combinations and arrangements of parts hereinafter described by way of example, and illustrated in the accompanying drawings of preferred embodiments in which.

In the various figures of the drawings, like reference characters designate like parts.

Figure 1:
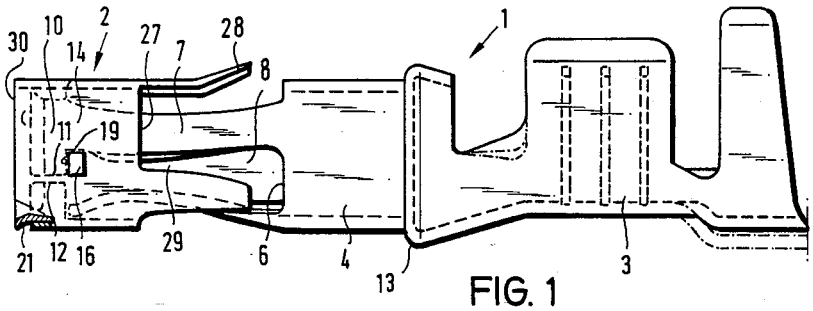
FIG. 1 shows a side view of a first embodiment of a round plug socket in accordance with the present invention.
Figure 2:
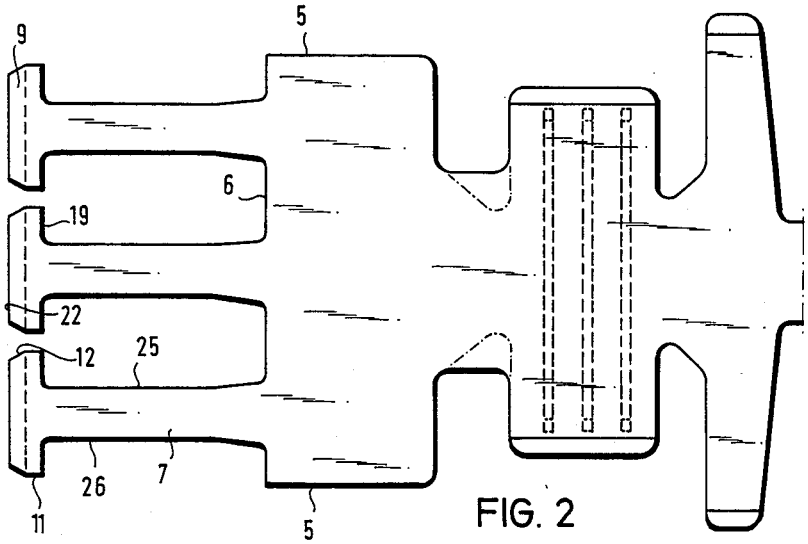
FIG. 2 shows a plan view of a blank for forming the round plug socket of FIG. 1.
Figure 3:
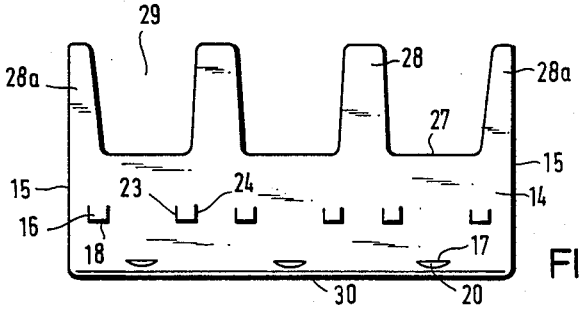
FIG. 3 shows a plan view of a blank for forming the over-spring of FIG. 1.

Referring now to FIGS. 1–3 of the drawings, the round plug socket 1, being a sheet-metal stamped part as shown in FIG. 2, is fitted with an over-spring 2, being a steel plate part as shown in FIG. 3. The round plug socket 1 includes a conductor securing portion 3, which can correspond to any of the usual spatial forms. Instead of the conductor securing portion 3, there can also be provided a soldering connection part. The conductor securing portion 3 extends into a cylindrically rolled spring arm base part 4. The longitudinal edges 5 of the base part 4 are arranged opposite one another in the blank form shown in FIG. 2, and abut one another when formed into the plug socket 1 as shown in FIG. 1. In this arrangement, in the transition part of the conductor securing portion 3 to the base part 4, there can be provided a bulge 13 to limit the amount of insertion of the plug socket 1 when being inserted into a conventional housing or casing made of insulation material (not shown), such housings and casings being well known in the art.

To the annular edge 6 of the base part 4, there are attached three spring arm contacts 7 arranged in a lateral spacing from one another, so that gaps or spaces 8 are formed. At the free ends of the spring arm contacts 7, there are provided cross straps 9 which extend at right angles to the longitudinal extent of the spring arm contacts 7. The straps 9 overhang the spring arm contacts 7 laterally to form a plug ring 10, the edges 11 and 12 of the transverse straps 9 being arranged opposite each other for abutting on one another as shown in FIG. 1. The spring arm contacts 7 are bent inward, as known per se, to form contact portions, so that in the interior of the socket 1 there is yielded a constriction of the cross section thereof as indicated in FIG. 1.

The plug ring 10 is embraced by a cylindrical spring ring portion 14 of the over-spring 2. The longitudinal edges 15 of the blank shown in FIG. 3 are arranged opposite one another for abutting one another when the over-spring 2 is formed as shown in FIG. 1. This over-spring ring portion 14 is provided so that the spring arm contacts 7 cannot bend too far radially outward.

The unreleasable seating of the over-spring ring portion 14, and therefore of the over-spring 2, is expediently ensured by cut-out tabs 16 and incisions 17 provided in the ring portion 14. The tabs 16 are bent inward with the free rest edge 18 of each tab 16 engaging behind a rear edge 19 of a respective cross strap 9, as shown in FIG. 1. The zone 20, which is present on the front edge side of each incision 17, is pressed in as a corrugation to form an impact edge 21 which abuts against the front edge 22 of a respective cross strap 9, as shown in FIG. 1. The vertical spacing of the edge 18 to the incision 17 corresponds to the width of the plug ring 10, the incision 17 being arranged, as depicted in FIG. 3, in each case between two tabs 16.

The tabs 16 fulfill a further essential function. The side edges 23 or 24 of the tabs 16, on widening or opening of the plug ring 10, for example in the inserting of a plug (not represented) or tilting of a plug, strike against a side edge 25 or 26 of the spring arm contacts 7, so that a further opening of the over-spring ring portion 14 is no longer possible. This limitation presents a very effective protection against any over-bending of the spring arm contacts.

According to the present invention, on the rear edge 27 of the over-spring ring portion 14, there are connected two spring arm stops 28 having a lateral spacing from one another, the spring arm stops extending rearward and being bent outward. It is advantageous, as depicted in FIG. 3, to provide three spring arm stops 28, in which arrangement one of the spring arm stops can be composed of two parts 28*a*, and in each case, the edge 15 is extended in the longitudinal middle between the parts 28*a*.

The over-spring 2 is seated on the round plug socket 1 expediently in such a way that the spring arm stops 28 are disposed over the gaps 8, so that the spring arm contacts 7 extend below the gaps 29 provided between the spring arm stops 28. Through this arrangement, it is achieved that the spring arm stops 28 can be yielded inwardly freely upon insertion thereof into a casing (not represented) intended therefor. The front edge 30 of the over-spring 2 overhangs expediently the front edge 22 of the round plug socket 1, so that the plug ring 10 is also thus protected by the over-spring 2.

Figure 4:
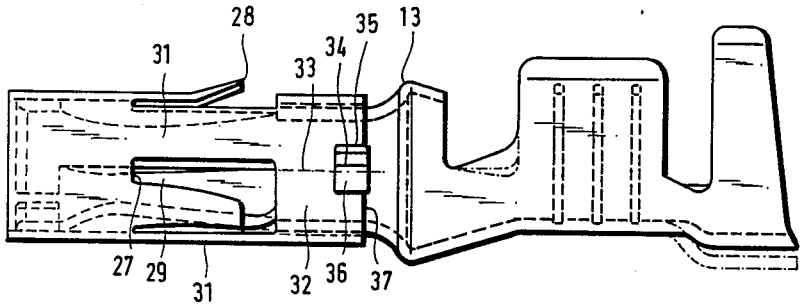
FIG. 4 shows a side view of another embodiment of the round plug socket.

In the modified embodiment according to FIG. 4, the over-spring 2 includes other features in comparison to the round plug socket 1 according to FIGS. 1 to 3. The elements ensuring the unreleasable seating and the over-bending protection in this modified form according to FIG. 4 includes connecting straps 31, which are attached in the gaps 29 to the rear edge 27. The straps 31 extend rearward between two spring arm stops 28 and are seated in one piece on a cylindrical clamping ring 32. The longitudinal edges 33 of the clamping ring 32 are arranged opposite one another for abutting on one another as shown in FIG. 4. The unreleasable seating of this over-spring and the over-bending protection provided thereby, are ensured by having at least one tab 34 cut out from the cylinder wall of the clamping ring 32 in a transverse or circumferential direction. The tab 34 is flanged inward so that in the process thereof, it grips about a longitudinal edge 35 of a hole 36 formed in spring arm base part 4, the hole 36 corresponding to the form of the tab 34. Preferably, there are provided two holes 36 and two associated tabs 34, the tabs 34 being flanged in opposite directions.

Expediently, the tabs 34, as depicted in FIG. 4, are cut out on the rear edge 37 of the clamping ring 32, which facilitates the assembling thereof. By the flanging of the tabs 34, the radial expansion of the over-spring is rendered difficult. In this construction, expediently, the longitudinal impact edges of the over-spring 2 should not lie in the zone of the longitudinal impact edges of the round plug socket 1, but should lie off-set from one another on the circumference, as shown in FIG. 4.

Figure 5:
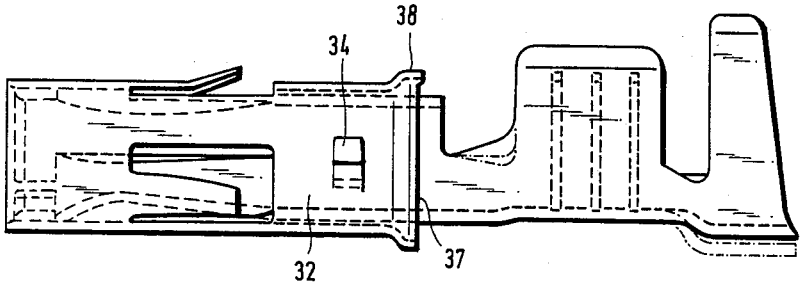
FIG. 5 shows a side view of a third embodiment of the round plug socket.

The further modified embodiment, according to FIG. 5, resembles the modified form according to FIG. 4, except for the elimination of the bulge 13 on the round plug socket 1. Instead of the bulge 13, there is provided a bulge 38, preferably, on a portion of the rear edge 37 of the clamping ring 32 of the over-spring 2. The bulge 38 also limits the amount of insertion of the plug socket 1 into a conventional housing or casing, however this latter formation simplifies the shaping of the round plug socket 1 and does not complicate the shaping of the over-spring 2. In connection with the bulge 38, it is expediently provided that the tabs 34 in the shell surface are arranged, as depicted in FIG. 5, in front of the bulge 38 in the clamping ring 32.

With the present invention, it is possible to simplify the form of the plug ring 10 of the spring arm contacts 7, and through the connection of the spring arm stops 28 to the over-spring ring portion 14, it is possible to shorten the structural length of the round plug socket 1 quite considerably when provided with the over-spring 2. Moreover, the assembling of the over-spring 2 of the present invention is substantially simpler than the prior art over-springs. Furthermore, there is achieved an over-bending protection with the present invention without it being necessary to provide a closed ring for this purpose as required in the prior art.

Figure 6:
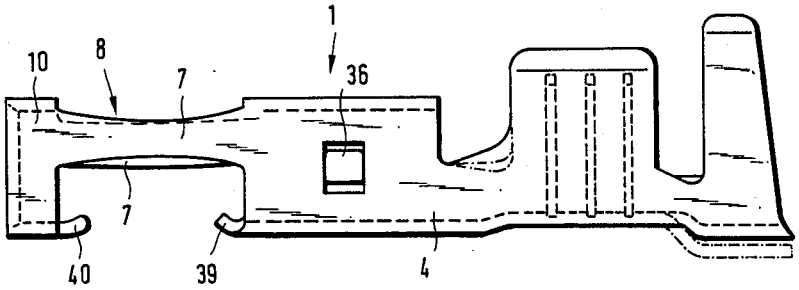
FIG. 6 shows a side view of a further embodiment of the round plug socket.
Figure 7:
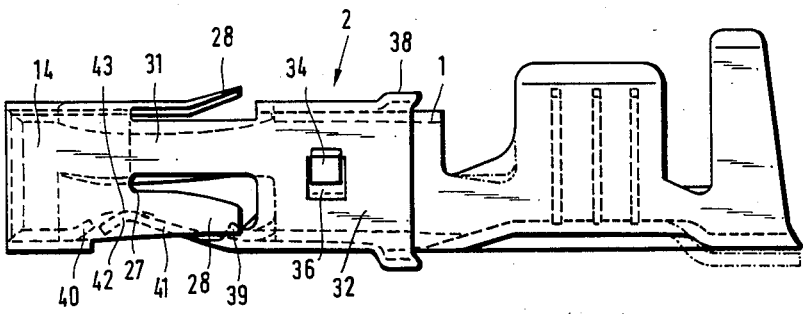
FIG. 7 shows a side view of the round plug socket of FIG. 6 provided with a modified over-spring.

Another special modified form of the present invention is depicted in FIGS. 6 and 7, it being a variant of the form represented in FIG. 5. Correspondingly, the round plug socket 1 is constructed cylindrically in the zone of the spring arm base part 4, and provides at least one hole 36 in the cylindrical shell thereof. From the spring arm base part 4, however, only two adjacent spring arm contacts 7 extend foward arranged in a lateral spacing from one another, so that there is formed a gap or spacing 8 between the spring arm contacts 7. At the front end, the spring arm contacts 7 are connected to a plug ring 10, which preferably forms a closed ring. The plug ring 10 includes only two impact edges seated one on another, which extend in the longitudinal direction of the socket. With respect to the third spring arm contact, the middle portion thereof is cut out, so that there still remain only a tab 39 joined to the spring arm base part 4, and a tab 40 connected to the plug ring 10. The tabs 39 and 40 are, as depicted in FIG. 6, bent inward, i.e., toward the interior of the socket. The function of the inward-bent tabs 39 and 40 is explained further below.

On the socket 1, there is seated an over-spring 2 with at least one connecting strap 31. Preferably, however, two connecting straps 31 are arranged adjacent each other with a gap 29 therebetween. The straps 31 are joined to the rear edge 27 of the over-spring ring portion 14, and then extend rearward to be seated on the clamping ring 32. The unreleasable seating of the over-spring of this embodiment resembles the form of unreleasable seating according to FIG. 5, being ensured by at least one tab 34 cut out of the cylinder wall of the clamping ring 32, which tab 34 is flanged inward. In the process thereof, the tab 34 extends through the hole 36 and grips around one edge of the hole 36. Preferably, also in this case, two holes 36 and two associated tabs 34 are provided, the tabs 34 being oppositely flanged. Provided with the bulge 38, the over-spring 2 ends at the rearward edge thereof.

Between the connecting straps 31, as in the other forms of the present invention, there are arranged spring arm stops 28 on the over-spring 2.

According to the present invention, a third connecting strap is provided, extending from the clamping ring 33 but separated from the over-spring ring portion 14, being bent inward to provide a contact spring tongue 41. The tongue 41 grips into the longitudinal space between the two socket tabs 39 and 40. In the front end portion, the tongue is provided with a bow 42 which is bent outward, so that there is provided a convexly formed contact area 43.

The plugged contact pin (not represented), in the modified form according to FIGS. 6 and 7, is pressed by the spring force of the contact spring tongue 41 against the preferably inward-bent spring arm contacts 7, whereby there is ensured a very good contact therebetween. The tabs 39 and 40, likewise bent inward, prevent an over-bending of the contact spring tongue 41, because they support the inserted contact pin in a radial direction, so that the pin can press back the tongue 41 only as far as an intended connecting line drawn between the ends of the tabs 39 and 40.

Numerous alterations of the structure herein disclosed will suggest themselves to those skilled in the art. However, it is to be understood that the present disclosure relates to preferred embodiments of the invention which are for purposes of illustration only and are not to be construed as a limitation of the invention.

What is claimed is:

1. A round plug socket comprising:

a conductor securing portion and a cylindrical spring arm base portion provided with spring arms connected to a front edge of said spring arm base portion, said spring arms extending forward away from said conductor securing portion, said spring arms being bent inward toward each other and being spaced from one another, a plug ring being provided on a front side of said spring arms;

said plug ring being embraced by a ring portion of an over-spring, said ring portion being slit in a longitudinal direction of said round plug socket; and securing means for unreleasably seating said over-spring ring portion on said round plug socket, said securing means also limiting expansion of said over-spring to protect against any over-bending of said spring arms during contact thereof with a male plug inserted into said round plug socket;

said securing means including tabs provided in said ring portion, said tabs being bent inward and pointing forward in an arrangement about a generetrix line of said ring portion;

said securing means also including forward edges provided in said ring portion, said forward edges being bent inward and being arranged on another generetrix line;

front edges of said tabs and said forward edges in said ring portion being arranged oppositely to each other to provide a perpendicular spacing therebetween corresponding to a width of said plug ring;

said tab front edges engaging a rear edge of said plug ring, and said ring portion forward edges engaging a front edge of said plug ring.

2. A round plug socket according to claim 1, wherein said spring arms include cross straps on said front side to define said plug ring, said cross straps extending at a right angle to a longitudinal extent of said spring arms and overhanging said spring arms laterally, edges of said cross straps being arranged opposite one another.

3. A round plug socket according to claim 1, wherein side edges of said tabs abut side edges of said spring arms in such a manner that said side edges prevent said expansion of said over-spring.

4. A round plug socket according to claim 1, wherein said round plug socket is slit in a longitudinal direction, said slit of said round plug socket and said ring portion slit of said over-spring being arranged offset circumferentially to one another.

5. A round plug socket according to claim 1, wherein at least one outward-bent spring arm stop is connected to a rear edge of said ring portion of said over-spring.

6. A round plug socket according to claim 5, wherein three spring arm stops are provided with gaps therebetween, said over-spring being seated on said round plug socket in such a manner that said spring arm stops are positioned over the spacings between said spring arms, and said spring arms extend below the gaps between said spring arm stops.

7. A round plug socket according to claim 1, wherein a front edge of said over-spring overhangs a front edge of said round plug socket.

8. A round plug socket according to claim 1, wherein said over-spring is provided with a bulge on a rearward portion thereof to limit the amount of insertion of said round plug socket into a casing which is adapted to receive said round plug socket.

9. A round plug socket including a conductor securing portion and a cylindrical spring arm base portion provided with at least one spring arm contact connected to a front edge of said spring arm base portion, said spring arm contact extending forward away from said conductor securing portion, said spring arm contact being bent inward, a plug ring being provided on a front side of said spring arm contact, said plug ring being embraced by a ring portion of an over-spring, said ring portion being slit in a longitudinal direction of said round plug socket, first and second tabs being laterally spaced from said spring arm contact and lying longitudinally opposite one another, said first tab being connected to said spring arm base portion and said second tab being connected to said plug ring, said first and second tabs being bent inward, said over-spring being seated over said round plug socket, at least one connecting strap being connected to a rear edge of said ring portion and extending rearward to provide a rear clamping ring, spring arm stops also being connected to said rear edge of said ring portion and extending rearward adjacent to said connecting strap, a forward-extending contact spring tongue being connected to said clamping ring, said contact spring tongue being bent inward to grip into a longitudinal space between said first and second tabs of said round plug socket.

10. A round plug socket according to claim 9, wherein a front end portion of said tongue is bent outward to provide a bow.

11. A round plug socket according to claim 9, wherein two adjacent spring arm contacts are provided, said spring arm contacts being laterally spaced from one another to provide a gap between said spring arm contacts, said spring arm contacts being attached to said plug ring to provide a closed ring having only two impact edges seated one upon another.

12. A round plug socket according to claim 9, wherein a cylindrical shell of said spring arm base portion is provided with at least one hole, and a tab cut out from a cylinder wall of said clamping ring, said cut-out tab being flanged inward to grip about an edge of said hole.

13. A round plug socket according to claim 9, wherein two holes are provided in a cylindrical shell of said spring arm base portion, and two tabs cut out from a cylinder wall of said clamping ring, said cut-out being oppositely flanged inward to grip about an edge of an associated one of said holes respectively.

14. A round plug socket according to claim 9, wherein said over-spring is provided with a bulge on a rearward portion thereof to limit the amount of insertion of said round plug socket into a casing which is adapted to receive said round plug socket.

15. A round plug socket comprising:

a conductor securing portion and a cylindrical spring arm base portion provided with spring arms connected to a front edge of said spring arm base portion, said spring arms extending forward away from said conductor securing portion, said spring arms being bowed inwardly toward each other and being spaced from one another;

each of said spring arms including cross straps on a front side to provide a plug ring, said cross straps extending at a right angle to a longitudinal extent of said spring arms and overhanging said spring arms laterally, edges of adjacent ones of said cross straps being arranged adjacent to one another to provide a circumferential arrangement;

an over-spring including ring means for engaging said plug ring to prevent over-bending of said spring arms during contact thereof with a male plug inserted into said round plug socket;

said ring means including a ring portion embracing said plug ring and extending over the inward most bowed portions of said spring arms, said ring portion being slit in a longitudinal direction of said round plug socket;

securing means for unreleasably seating said over-spring ring portion on said round plug socket, said securing means also limiting expansion of said over-spring;

said securing means including at least one connecting strap extending rearward from a rear edge of said ring portion, said strap extending in one piece to provide a rear cylindrical clamping ring with adjacent longitudinal impact edges of said clamping ring being abuttingly arranged; and said securing means further including at least one tab and an associated hole for receiving said tab, said tab being cut from a cylinder wall of said clamping ring, said hole being provided in said spring arm base portion, said hole corresponding to the form of said tab;

said tab being transversely directed and being flanged inwardly to grip about a longitudinal edge of said hole to join said clamping ring and said spring arm base portion together.

16. A round plug socket according to claim 15, wherein two circumferentially spaced apart tabs and two associated holes are provided in said clamping ring and said spring arm base portion respectively, said two tabs being oppositely flanged.

17. A round plug socket according to claim 15, wherein a rear edge of said clamping ring of said over-spring is provided with a bulge to limit the amount of insertion of said round plug socket into a casing which is adapted to receive said round plug socket.

18. A round socket according to claim 15, wherein said tab is cut out on a rear edge of said clamping ring.

19. A round plug socket according to claim 17, wherein said tab is arranged in a shell surface of said clamping ring in front of said bulge.

20. A round plug socket according to claim 15, wherein said round plug socket is slit in a longitudinal direction, said slit of said round plug socket and said ring partion slit of said over-spring being arranged offset circumferentially to one another.

21. A round plug socket according to claim 15, wherein at least one outward-bent spring arm stop is connected to a rear edge of said ring portion of said over-spring.

22. A round plug socket according to claim 21, wherein three spring arm stops are provided with gaps therebetween, said over-spring being seated on said round plug socket in such a manner that said spring arm stops are positioned over the spacings between said spring arms, and said spring arms extend below the gaps between said spring arm stops.

23. A round plug socket according to claim 15, wherein a front edge of said over-spring overhangs a front edge of said round plug socket.

* * * * *